US005762085A

United States Patent [19]

Punch

[11] Patent Number: 5,762,085

[45] Date of Patent: Jun. 9, 1998

[54] VERSATILE AND ADJUSTABLE FOLDING HUNTERS GROUND BLIND

[76] Inventor: Timmy J. Punch, 418 Garland Dr. #203, Lake Jackson, Tex. 77566

[21] Appl. No.: 823,359

[22] Filed: Mar. 24, 1997

[51] Int. Cl.[6] ..... E04H 15/14

[52] U.S. Cl. ..... 135/93; 135/117; 135/901; 135/115

[58] Field of Search ..... 135/900, 901, 135/902, 117, 119, 151, 155, 115, 161, 91, 93, 94, 96, 127

[56] References Cited

U.S. PATENT DOCUMENTS

| | | | |
|---|---|---|---|
| 2,528,721 | 11/1950 | Brockman et al. | 135/900 |
| 2,942,609 | 6/1960 | Ferguson | 135/93 |
| 3,148,688 | 9/1964 | Arnopole | 135/93 |
| 3,757,360 | 9/1973 | Wescott | 135/96 |
| 3,848,279 | 11/1974 | Ipsen, Jr. | 135/96 |
| 4,067,346 | 1/1978 | Husted | 135/901 |
| 4,165,757 | 8/1979 | Marks | 135/119 |
| 4,265,261 | 5/1981 | Barker | 135/93 |
| 4,883,206 | 11/1989 | Miller | 135/96 |
| 5,096,214 | 3/1992 | Walker et al. | 135/901 |
| 5,377,711 | 1/1995 | Mueller | 135/901 |

FOREIGN PATENT DOCUMENTS

| | | | |
|---|---|---|---|
| 1246303 | 10/1960 | France | 135/93 |

*Primary Examiner*—Lanna Mai

[57] ABSTRACT

A hunters ground blind including a frame portion. Further provided is cover system dimensioned for extending over the frame portion. Situated on the cover is a front window with a plurality of vertical strips and a penetrateable screen removably coupled thereover. Also included is a pair of inverted L-shaped slots formed in the cover system which are each adapted to allow the selective opening thereof when hunting various game.

2 Claims, 10 Drawing Sheets

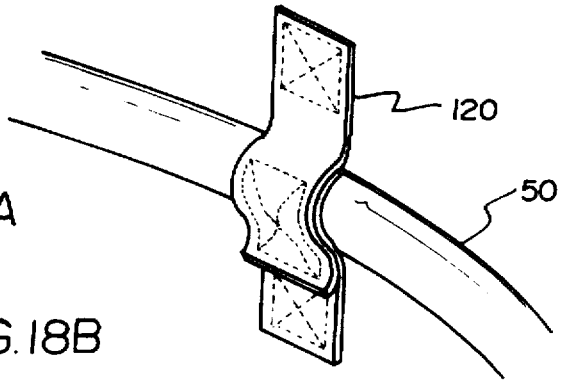
FIG. 18A
FIG. 18B
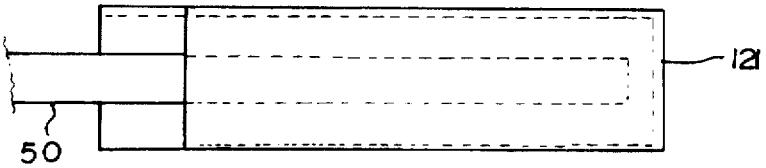
FIG. 19
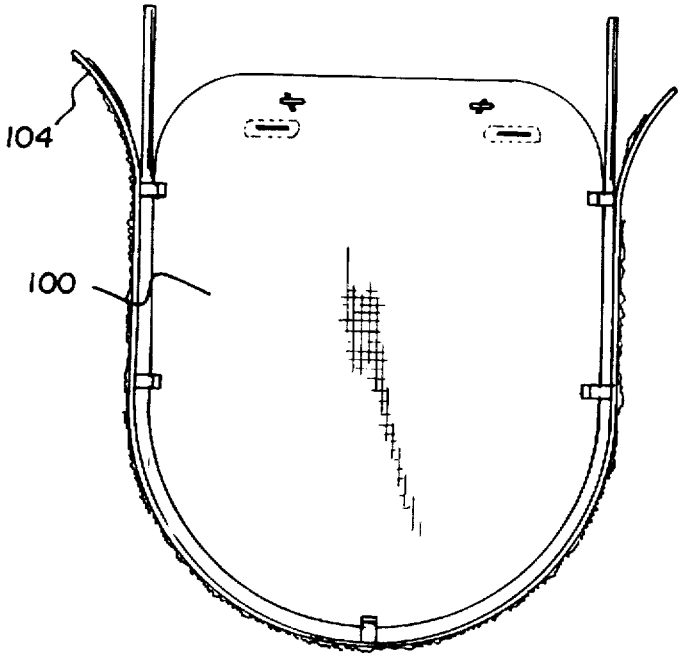

VERSATILE AND ADJUSTABLE FOLDING HUNTERS GROUND BLIND

BACKGROUND OF THE INVENTION

1. Field of the Invention

The present invention relates to a folding hunters ground blind and more particularly pertains to providing a blind which is adjustable thereby accommodating various types of hunting.

2. Description of the Prior Art

The use of portable blinds is known in the prior art. More specifically, portable blinds heretofore devised and utilized for the purpose of concealing an observer are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,377,711 to Mueller discloses a camouflage blind for hunters.

U.S. Pat. No. 5,062,234 to Green discloses a portable blind.

U.S. Pat. No. 4,798,019 to Sury et al. discloses a portable blind.

U.S. Pat. No. Des. 350,399 to Bodrie discloses the ornamental design for a hunting blind.

U.S. Pat. No. 4,723,371 to Williams discloses a self supported, collapsible, and portable walled structure suitable for use as a hunting blind.

U.S. Pat. No. 4,777,755 to Colburn discloses a portable hunting blind and shelter.

U.S. Pat. No. 4,186,507 to Stinnett discloses a portable duck blind.

In this respect, the folding hunters ground blind according to the present invention substantially departs from the conventional concepts and designs of the prior art, and in so doing provides an apparatus primarily developed for the purpose of providing a blind which is adjustable thereby accommodating various types of hunting.

Therefore, it can be appreciated that there exists a continuing need for a new and improved folding hunters ground blind which can be used for providing a blind which is adjustable thereby accommodating various types of hunting. Further, there is an evident need for a blind with features for improved concealment of a user. In this regard, the present invention substantially fulfills this need.

SUMMARY OF THE INVENTION

In view of the foregoing disadvantages inherent in the known types of portable blinds now present in the prior art, the present invention provides an improved folding hunters ground blind. As such, the general purpose of the present invention, which will be described subsequently in greater detail, is to provide a new and improved folding hunters ground blind which has all the advantage s of the prior art and none of the disadvantages.

To attain this, the present invention essentially comprises a folding frame portion including a top member, a bottom member, a front member, and a rear member. The top member has a generally rectangular shaped perimeter. A plurality of cross members extend between long supports of the perimeter. The bottom m ember has a generally rectangular shaped perimeter including telescoping long and short supports. Corners of the bottom member have upwardly extending receiving tubes disposed thereon. The front member has upper members and lower members. The upper members are telescopically received within the lower members. The lower members are coupled with two of the upwardly extending receiving tubes of the bottom member. The upper members have a hinge member coupled to the top member. A U-shaped support extends between upper ends of the lower members of the front portion. The rear member has opposed upper members and lower members. The upper members of the rear member are telescopically coupled with the lower members of the rear member. The lower members of the rear member are coupled with two of the upwardly extending receiving tubes of the bottom member. The upper members of the rear member have a hinge member coupled to the top member. An adjustable arcuate support member is secured to the cover system in the front of, or around the rear member of the folding frame portion. Such arcuate member extends around a rear portion of the frame portion for providing more room within the blind for bow hunting and the like. A two-layer cover system is dimensioned for adjustably extending over the folding frame portion and the arcuate support member to form an enclosure. The cover system includes an interior layer fabricated of waterproof camouflage material. The interior layer includes a pair of door portions formed by inverted L-shaped vertical slots formed therethrough. The vertical slots have a pile type fastener strip and a zipper disposed thereon corresponding to a pile type fastener strip and a zipper on the pair of door portions for closure thereof. Preferably, the zipper is located on a top horizontal portion of the L-shaped slot and the pile fastener is located on a bottom vertical portion of the L-shaped slot. The slots may be selectively opened depending on what type of game is being hunted. The interior layer includes adjustable front, side and rear windows. The interior layer has adjustable tie down strips disposed on lower ends thereof. The cover system also includes an exterior layer comprised of three dimensional camouflage panels securable to the interior layer. The exterior layer further includes attachable vegetation. The front window is equipped with a versatile front window which has a quietly or near-silent removable screen selectively situated thereover, whereby the screen is adapted to be penetrated by a weapon during use while also allowing comfortable hunting in "insect-infested" forest areas. Such front window is equipped with a plurality of vertical strips removably coupled thereover. The frame further has a removable awning with a semicircular configuration situated above the front window to help preclude light from entering the blind while offering a "tree-like" shape to the blind.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved folding hunters ground blind which has all the advantages of the prior art portable blinds and none of the disadvantages.

It is another object of the present invention to provide a new and improved folding hunters ground blind which may be easily and efficiently manufactured and marketed.

It is a further object of the present invention to provide a versatile folding hunters ground blind which is of a durable and reliable construction.

An even further object of the present invention is to provide a new and improved folding hunters ground blind which is susceptible of a low cost of manufacture with regard to both materials and labor, and which accordingly is then susceptible of low prices of sale to the consuming public, thereby making such folding hunters ground blind economically available to the buying public.

Still yet another object of the present invention is to provide a new and improved folding hunters ground blind which provides in the apparatuses and methods of the prior art some of the advantages thereof, while simultaneously overcoming some of the disadvantages normally associated therewith.

Still another object of the present invention is to provide a blind which is adjustable thereby accommodating various types of hunting, ice fishing, observing wildlife, and photographing wildlife.

Another object of the present invention is to provide a blind which may be maneuvered and adjusted in a quiet manner.

Lastly, it is an object of the present invention to provide a new and improved hunters ground blind including a frame portion. Further provided is cover system dimensioned for extending over the frame portion. Situated on the cover is a front window with a plurality of vertical strips and a penetrateable screen removably coupled thereover. Also included is a pair of inverted L-shaped slots formed in the cover system which are each adapted to allow the selective opening thereof when hunting various game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is a plan view of the present invention depicting the optional use of the arcuate member for when the present invention is utilized for bow hunting and the like.

FIG. 14C is a perspective view of the present invention with at least one of the vertical slits having a portion thereof open with a screen positioned thereover. Further depicted are the sides of the covering bowed out by means of the arcuate rod forming a side window for affording a widened angle of view during bow hunting, observing or the like.

FIG. 18A is a perspective view of the pile fastener straps utilized to maintain the arcuate rod in its operative orientation.

FIG. 18B is a perspective view of a sleeve utilized to maintain the arcuate rods in their operative orientation.

FIG. 19 is a top plan view of the removable awning of the present invention.

Similar reference characters refer to similar parts throughout the several views of the drawings.

DESCRIPTION OF THE PREFERRED EMBODIMENT

Figure 2:
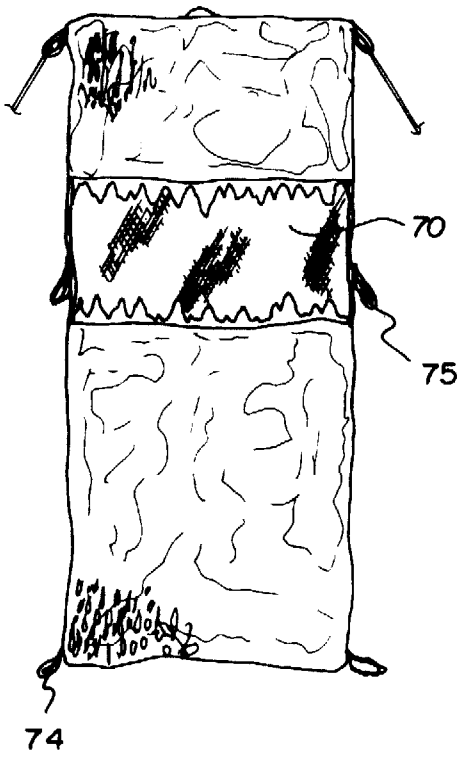
FIG. 2 is a front elevation view of the present invention with the cover in place depicting the front window thereof.
Figure 1:
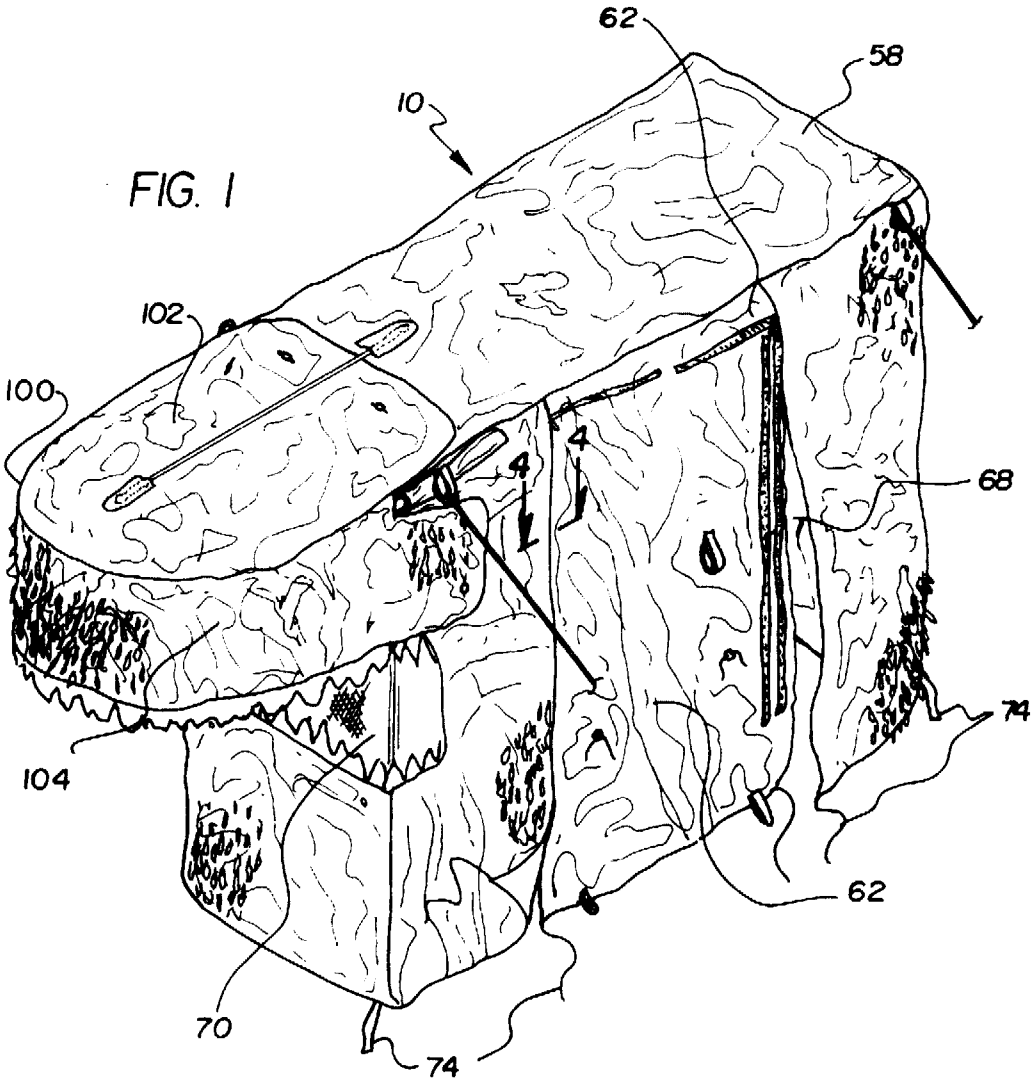
FIG. 1 is a perspective view of the first embodiment of the folding hunters ground blind constructed in accordance with the principles of the present invention.
Figure 3:
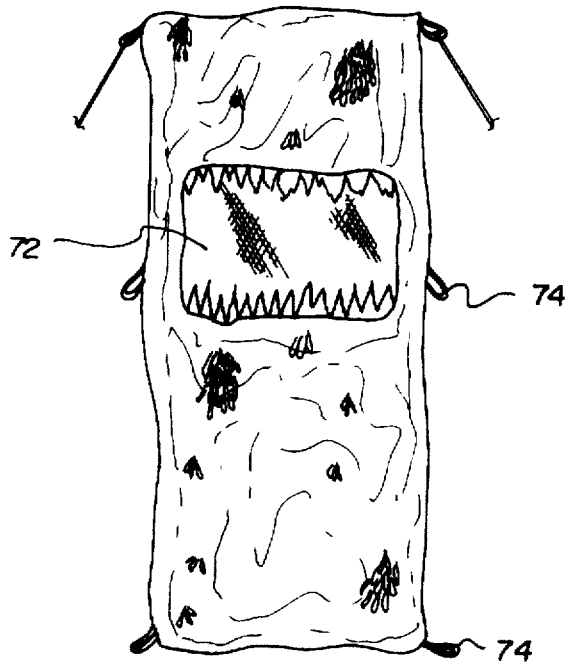
FIG. 3 is a rear elevation view of the present invention with the cover in place depicting the rear window thereof.
Figure 4:
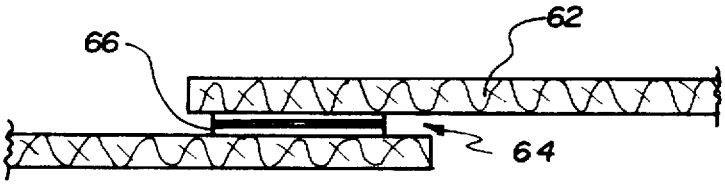
FIG. 4 is a cross-sectional view as taken along line 4—4 of FIG. 1.
Figure 6:
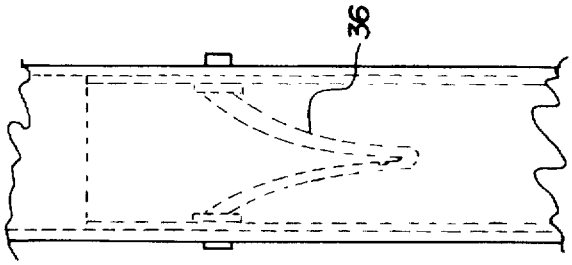
FIG. 6 is a cross-sectional view as taken along line 6—6 of FIG. 5 showing one of many various types of securement mechanisms that may be employed to maintain the frame assembled.
Figure 5:
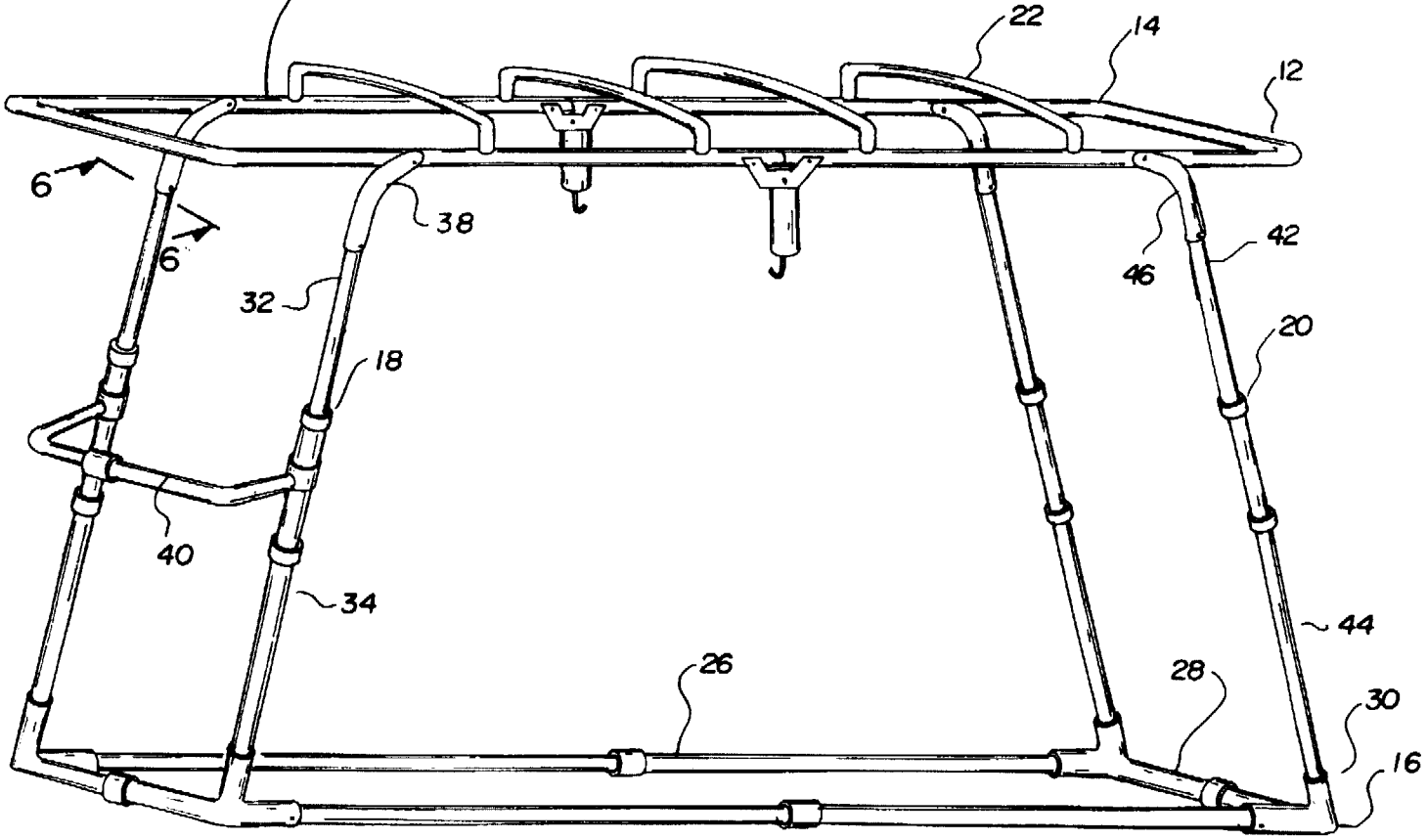
FIG. 5 is a perspective view of the foldable frame of the present invention in an erected orientation.
Figure 7:
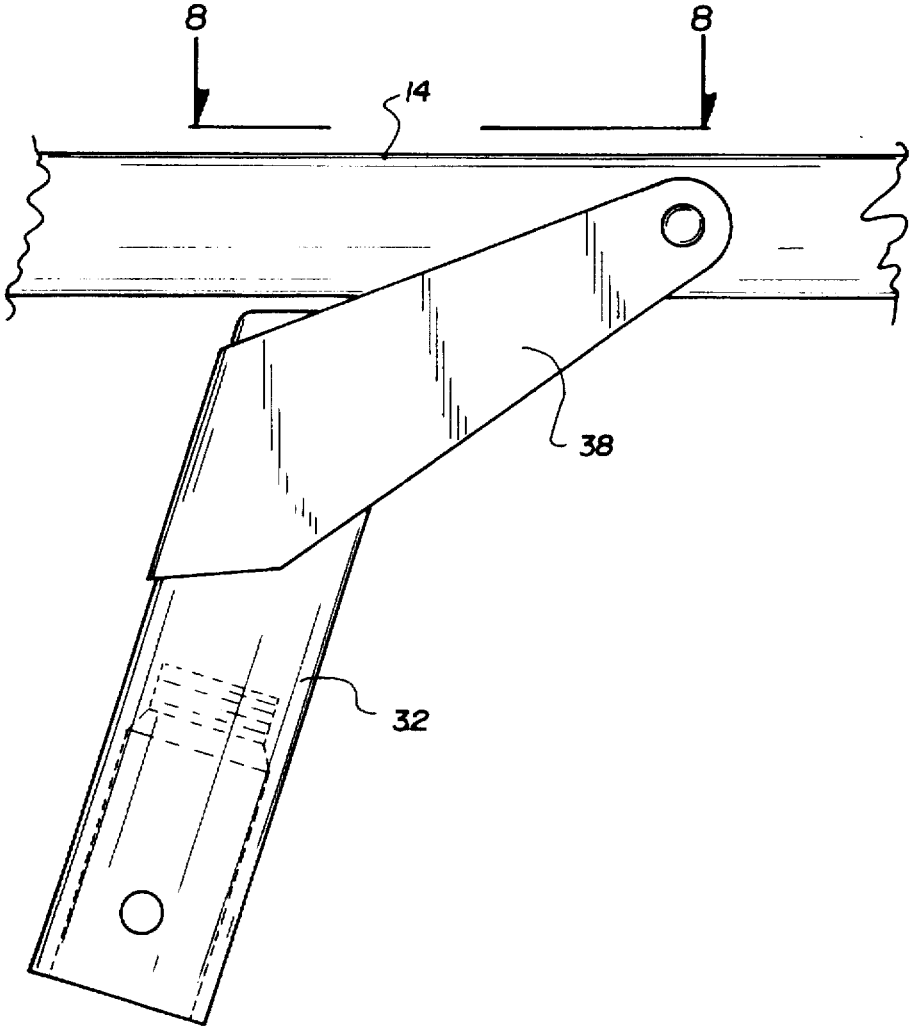
FIG. 7 is an isolated view of the hinged member of the frame.
Figure 8:
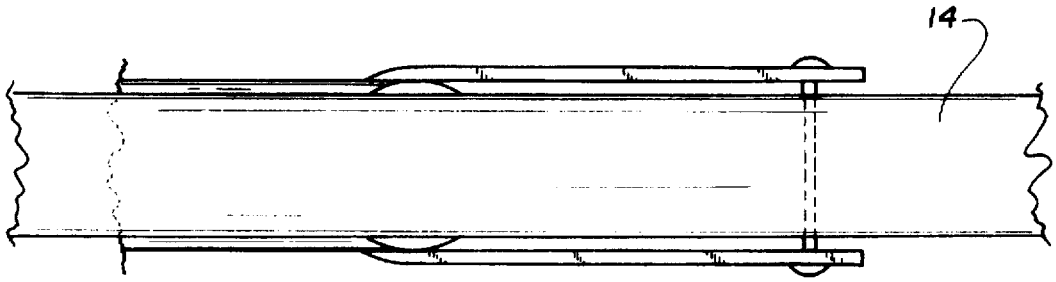
FIG. 8 is a cross-sectional view as taken along line 8—8 of FIG. 7.
Figure 9:
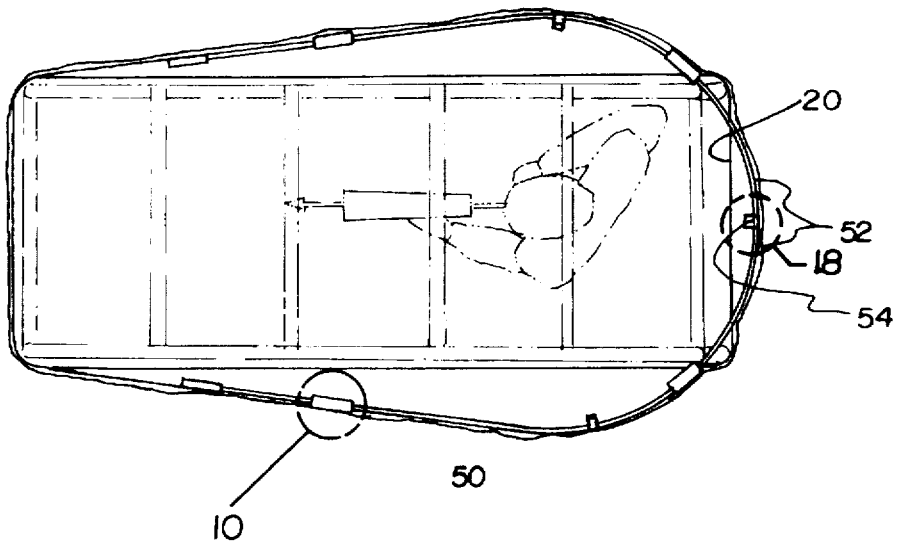
Figure 10:
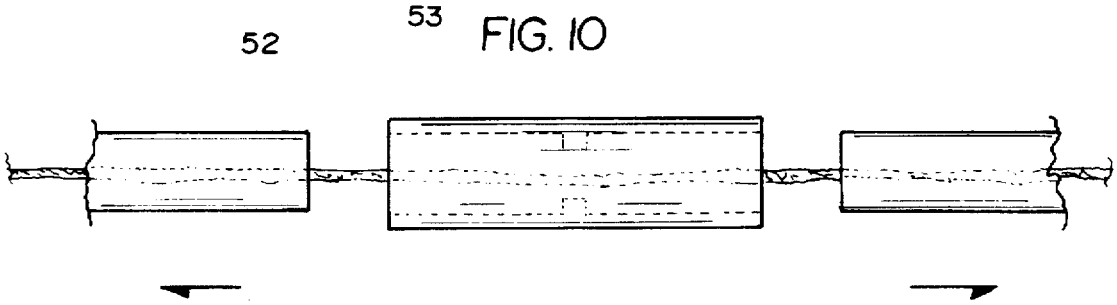
FIG. 10 is a partial plan view of the arcuate support member of the present invention illustrating the elastic cord thereof.
Figure 13:
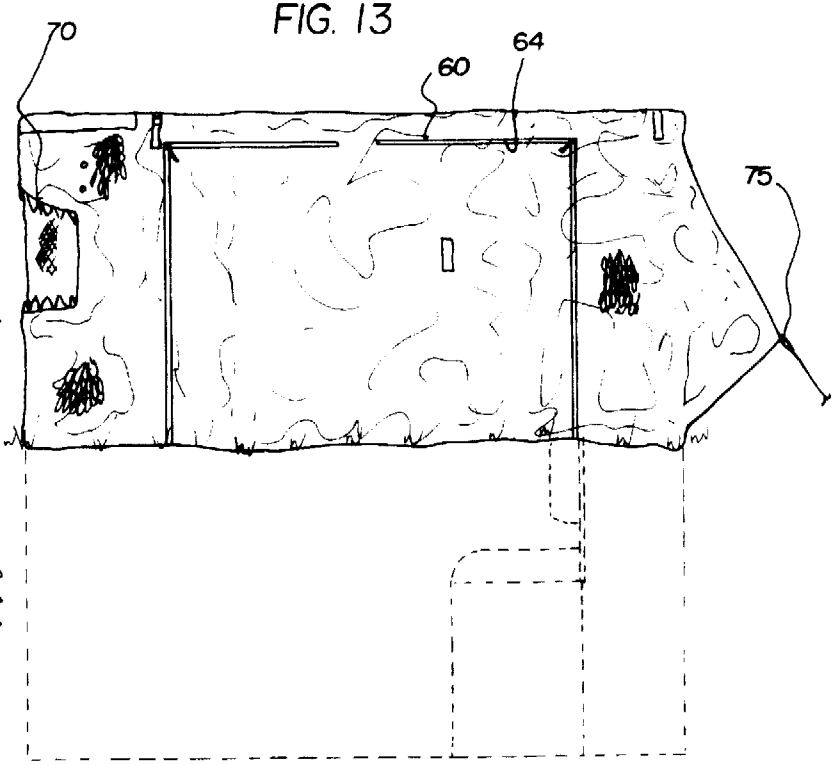
FIG. 13 is a side view of the present invention depicting a pit-blind set up and further showing the vertical L-shaped slots in a closed orientation for when the front window is only utilized during hunting.
Figure 12:
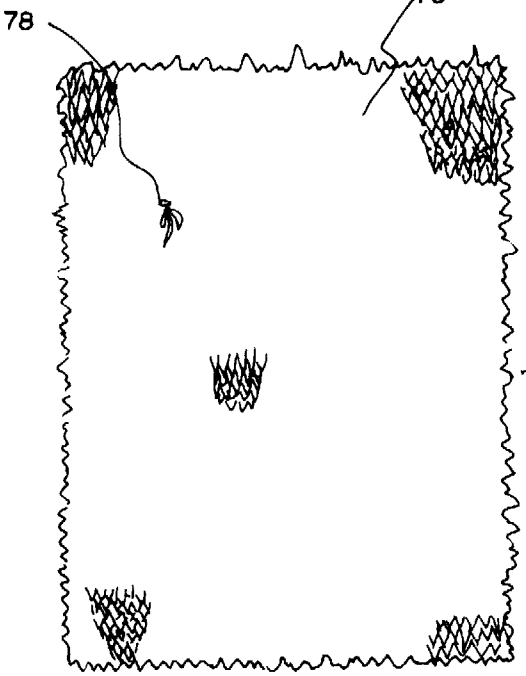
FIG. 12 is an isolated view of a 3—dimensional exterior layer comprising a plurality of panels.

With reference now to the drawings, and in particular, to FIGS. 1–19 thereof, the preferred embodiment of the new and improved folding hunters ground blind embodying the principles and concepts of the present invention and generally designated by the reference number 10 will be described.

Specifically, it will be noted in the various Figures that the device relates to a new and improved folding hunters ground blind for providing comfort and concealment for extended periods of hunting, observing, or photographing wildlife. In its broadest context, the device consists of a folding frame portion, an adjustable arcuate support member and a two-layer cover system. Such components are individually configured and correlated with respect to each other so as to attain the desired objective.

The device 10 includes a folding frame portion 12 with a top member 14, a bottom member 16, a front member 18, and a rear member 20. The top member 14 has a generally rectangular shaped perimeter. A plurality of cross members 22 extend between opposed long supports 24 of the perimeter. The bottom member 16 has a generally rectangular shaped perimeter including telescoping long 26 and short supports 28. Corners of the bottom member 16 have upwardly extending receiving tubes 30 disposed thereon. The front member 18 has opposed upper members 32 and lower members 34. The upper members 32 are telescopically received within the lower members 34 or vice-versa. The optional removal of the telescoping upper and lower members 32,34 is facilitated through the use of a pivot assembly 36 disposed therein. Note FIG. 6. The telescoping nature of the various members of the frame is preferably afforded by a screw compression member 37. It should be noted, however, that any one of various telescoping control mechanisms may be employed. The lower members 34 are coupled with two of the upwardly extending receiving tubes 30 of the bottom member 16. The upper members 32 have a hinge member 38 coupled to the top member. A U-shaped support 40 extends between upper ends of the lower members 34 of the front member 18. The rear member 20 has opposed upper members 42 and lower members 44. The upper members 42 of the rear member 20 are telescopically received within the lower members 44 of the rear member 20 or vice-versa. The adjustment of the telescoping upper and lower members 42,44 is facilitated through the use of compression members disposed thereon. Such compression members may be disposed either exterior or interior of the telescoping members and may utilize bushings or the like. The compression members may readily be found in the art of swimming pool brushes, camera stands, etc. Alternatively, various other methods of coupling may be utilized. For example, the upper and lower members may be foldable instead of telescoping and a collar may be disposed over the hinge point to selectively effect erection of the frame. The lower members 44 of the rear member 20 are coupled with two of the upwardly extending receiving tubes 30 of the bottom member 16. The upper members 42 of the rear member 20 have a hinge member 46 coupled to the top member 14. The folding frame portion 12 is adapted for disassembling and folding into a unit that one person can backpack into a wilderness site. The adjustable length frame members provide versatility, allowing the device 10 to fit into tight spots amidst brush, to adapt to uneven ground and to accommodate occupants of different heights and equipment of various sizes such as camera tripod or a long bow and shotgun.

An adjustable arcuate support member 50 is secured to and extends around the rear member 20 of the folding frame portion 12. The adjustable arcuate support member 50 is comprised of a plurality of hollow bendable arcuate segments 52 with an elastic band 53 situated therethrough such that the arcuate support member may be conveniently assembled to form a U-shaped support or collapsed for storage and travel. Further, the U-shaped support is adjustable in length to accommodate various uses, as will become apparent later. It should be noted that the adjustable arcuate support member is utilized whenever the environment permits. This enlarges the frame for additional space during any one of various activities including bow hunting. For maintaining the cover taut during use, the tie down strips 74 located at a bottommost end of the interior layer are utilized to hold tight the sides of the covering by wrapping underneath the frame and adjustably securing to complimentary strips situated on an interior surface of the interior covering adjacent a bottom extent thereof. This affords the tautness needed when utilizing the rear arcuate rod as well as keeping the walls of the enclosure rigid and less likely to be blown around in the wind. Also, it serves as a means for closing the bottom of the L-shaped slots. For facilitating the purpose thereof, the tie down strips are constructed from a flexible material. The complimentary strips are positioned to allow various height adjustments correlating to any frame adjustments.

Figure 11:
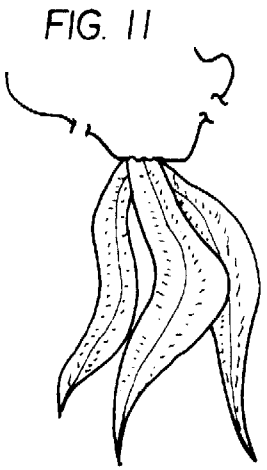
FIG. 11 is an isolated view of a leaf attachment of the present invention.

A two-layer cover system 58 is dimensioned for extending over the folding frame portion 12 and the arcuate support member 50 to form an enclosure. For reasons that will become apparent later, the cover system is slightly larger than the frame. The cover system 58 includes an interior layer 60 fabricated of a water-resistant camouflage material. The interior layer 60 includes a pair of door portions 62 formed by L-shaped vertical slots 64. While not shown, it should be noted that the door portions may be included on both sides of the present invention. The vertical slots 64 each have a pile type fastener strip 66 and a zipper disposed thereon corresponding to pile type fastener strip 68 and a zipper on each of the pair of door portions 62 for closure thereof. Preferably, the zipper is located on a top horizontal portion of the L-shaped slot and the pile fastener is located on a bottom vertical portion of the L-shaped slot. It should be noted that, alternatively, the zipper may also span down various lengths of the bottom vertical portion of the L-shaped slot including an entire length or a portion thereof. It should be understood that any part of the bottom vertical portion of the L-shaped slot that is not equipped with the zipper is, instead, preferably equipped with the pile fastener. The lower portions of the L-shaped slots are sized to allow various degrees of overlapping to compliment any alterations made to the frame. The interior layer 60 includes adjustable front and rear windows 70,72. The interior layer 60 has adjustable tie down strips 74 disposed on lower ends thereof and further loops 75 situated about the periphery at a central extent thereof. The loops are included for allowing the sides of the cover system to be bowed outwardly to a lesser degree than that which is accomplished by the arcuate rod. Further, the tie loops of each side may be employed independently of one another. Such features allow the interior space of the cover system to be enlarged in tight spots. The cover system 58 further includes an exterior layer 76 comprised of three dimensional camouflage panels securable to the interior layer 60. Note FIG. 12. The exterior layer 76 includes a plurality of holes, loops, etc for allowing the attachment of both natural and artificial vegetation 78. An example of artificial vegetation is shown in FIG. 11. The two-layer cover system 58 helps to make the device 10 appear more natural, with a "bushlike" surface or appearance to the device 10 rather than a flat sided appearance. The rounded corners formed by the device 10 adds a more natural, rounded appearance.

Figure 15:
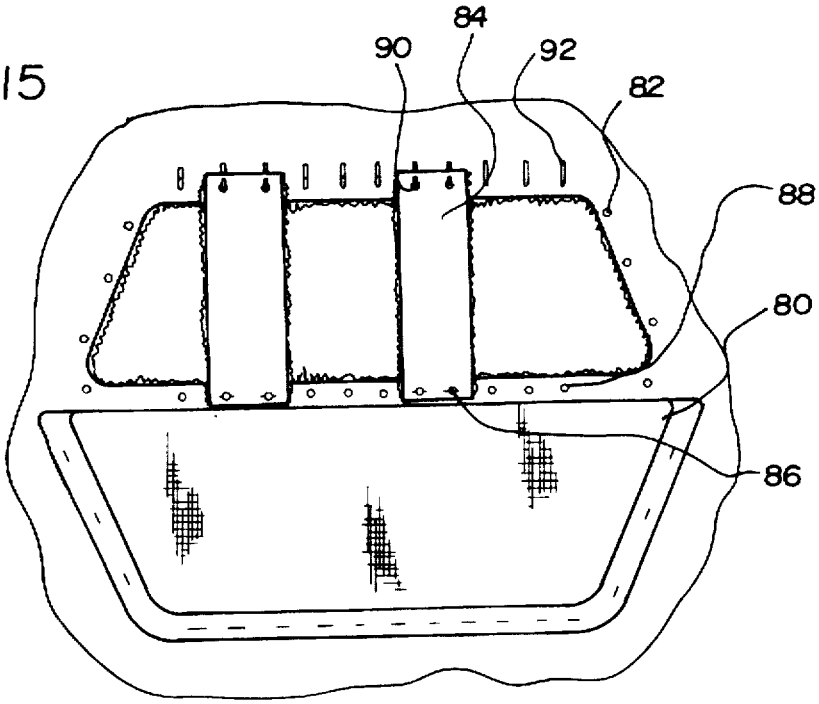
FIG. 15 is a front elevational view of the present invention showing the interior removable vertical flaps and removable penetrateable screen of the front window.

With reference of FIG. 15, the front window has a removable screen 80 selectively situated thereover. The screen is attached along a lower edge thereof to a lower edge of the front window via a zipper. The mesh screen may be secured over the front window via a plurality of buttons 82 and hooks 92 positioned along the periphery of window. The screen is designed to keep insects out but can be shot through when hunting with a razor-headed arrow. Further, a slit can be cut through the windows to allow a gun barrel to protrude therethrough while gun hunting. Also provided over the front window is a plurality of vertical strips 84 removably coupled thereto. Such strips each have a width less than ⅙ the width of the front window. Each strip is equipped with a pair of slits 86 adjacent a bottom edge thereof for securing to buttons 88 positioned on the lower edge of the window. A pair of reinforced eyelets 90 are situated adjacent an upper edge of each strip for releasably coupling with a plurality of hooks 92 positioned next to a top edge of the front window. In use, the strips reduce the amount of light that enters the blind and further conceals movement of a user therein. As shown in the Figures, all of the edges of the strips and the windows have leaf-shaped appendages protruding therefrom for affording a natural look. It should be noted that the rear window may be constructed with features similar to those of the front window. Further, all of the features associated with the windows are designed to be repositioned from inside the blind with very minimal noise.

Further provided is an awning 100 having a top face 102 with a semicircular configuration. The top face is connected to the frame above the front window in a plane in which the top of the blind resides. The top face is coupled by means of an arcuate rod which has ends which may be inserted within sleeves of the covering. Such awning further has a cover 104 formed of material similar to that of the cover system. When utilized, the cover suspends to an elevation level with the top edge of the front window for preventing light and rain from entering the blind.

Figure 16:
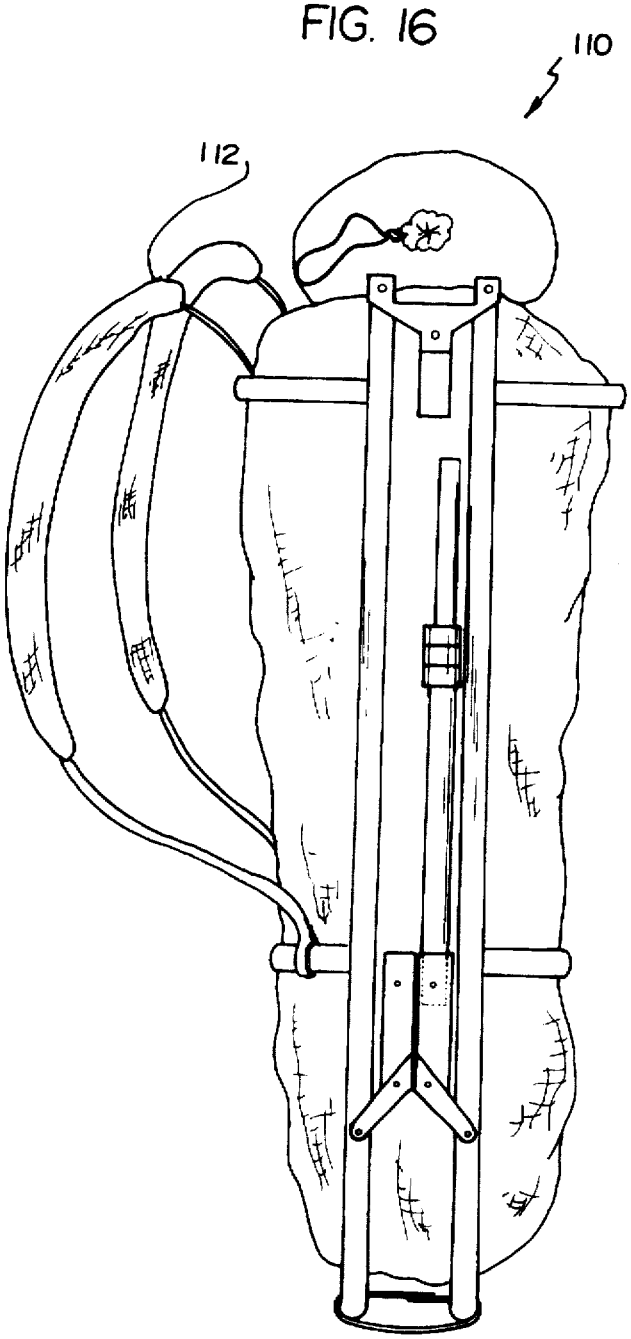
FIG. 16 is a side view of the present invention in a collapsed orientation with straps for allowing the present invention to be carried as a back-pack in which you can also carry small gear and the awning feature.
Figure 17:
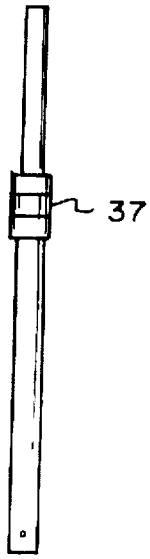
FIG. 17 is an example of one of the many various types of securement mechanisms for securing the relative position between the upper members and lower members.

To provide mobility, the foldable frame is adapted to collapse thereby forming a back pack 110. As shown in FIG. 16, such back pack is equipped with a pair of shoulder straps 112. To accomplish such collapsing, the telescoping long supports 26 of the frame are removed and shorted. Next, the front and rear members 18 & 20 are shortened and pivoted to reside in a plane in which the top member resides or can be removed completely and carried. Thereafter, the top member is folded along a central pivot point such that the cover system may be situated and contained between the cross members 22 or attached over cross members 22 and folded therein. Also, small gear and the awning device can be carried within the folded area.

Figure 14A:
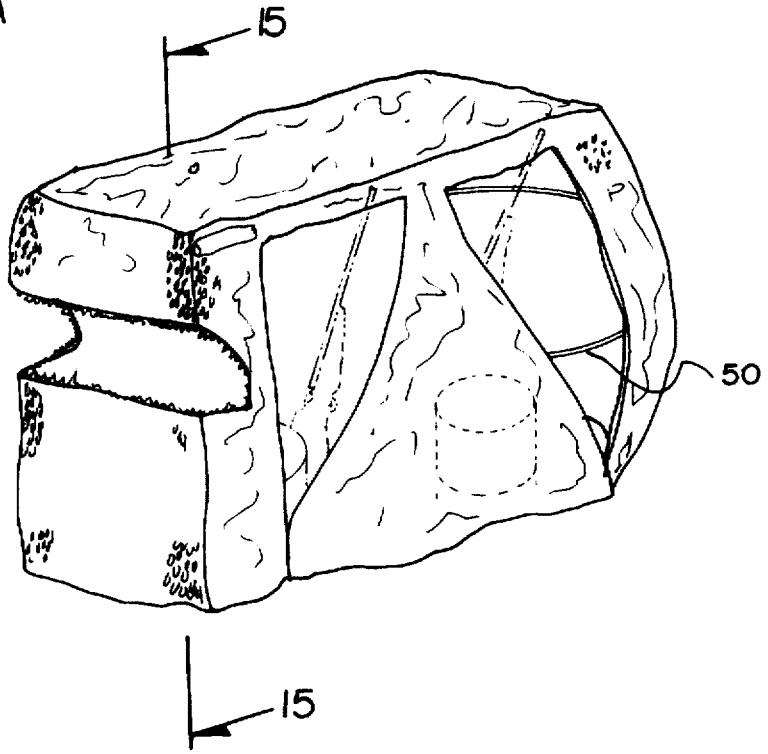
FIG. 14A is a perspective view of the present invention with both of the vertical L-shaped slots in an open orientation for when the present invention is utilized for waterfowl hunting.
Figure 14B:
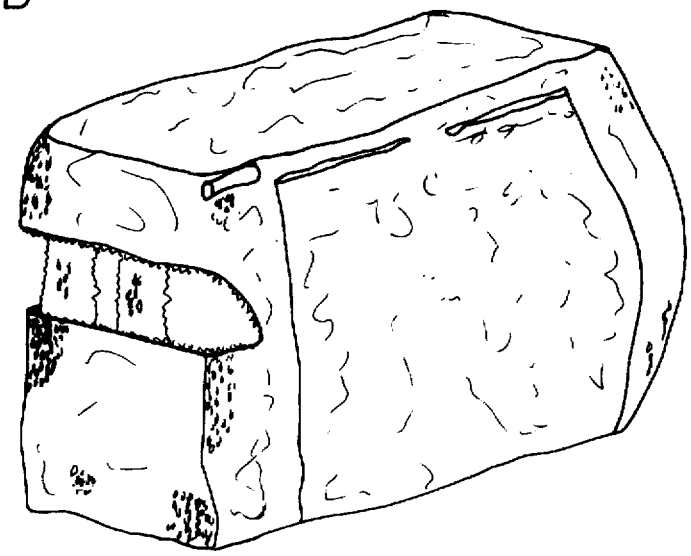
FIG. 14B is a perspective view of the present invention with both of the vertical slots in a closed orientation and further the vertical strips in place for when the present invention is utilized for deer hunting.
Figure 14C:
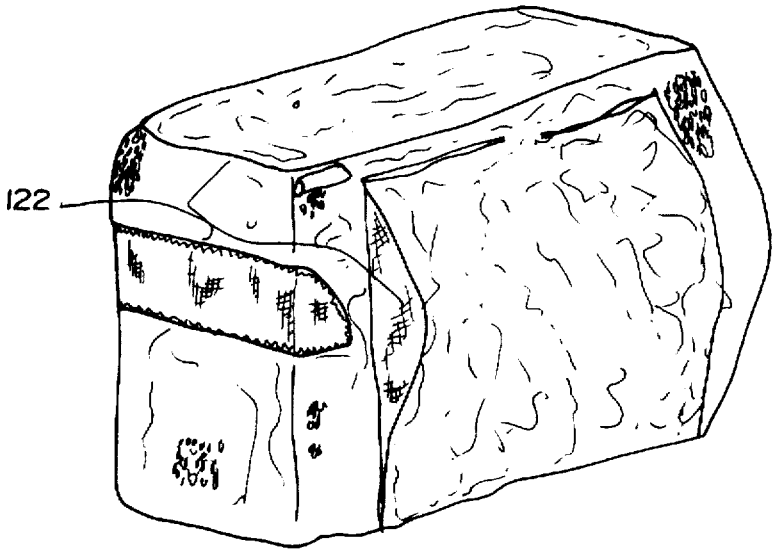

The present invention is designed to afford both adjustability and versatility in that it is capable of being altered in the field to accommodate the hunting of various types of game and utilizing various types of weapons. For example, when a user wishes to hunt with more interior room or with a compound bow, the arcuate support member may be assembled and attached to the interior layer of the cover system in a horizontal plane. To accomplish such attachment, a fastener strap 120 may be employed to attach the rear portion of the arcuate support to the rear face of the covering, as shown in FIG. 18A. Further, the ends of the arcuate member may be slidably inserted within sleeves 121 situated on the interior sides of the covering at a plurality of distances toward the front of the blind. Note FIG. 18B. As shown in FIG. 14C, the arcuate support may be utilized as indicated above and further a vertical portion of the front inverted L-shaped slots may be opened forming the side window feature. In addition, the screen may be disposed over the front opening and another triangular screen 122 may be situated in each of the vertical portions of the front inverted L-shaped slot via pile fasteners and buttons. By doing this, a widened angle of view is afforded during bow hunting or the like.

During hunting with a rifle, a user may choose to situate the end of such rifle between the vertical strips of the front window and rested on the gun rest 40. In the alternative, a slit may be made in the screen such that the rifle may be situated therethrough. Yet another option open to the hunter is to fire a bow directly through the screen.

The present invention is further adapted to be adjusted to accommodate the hunting of various game. For example during deer hunting, a user may close both of the inverted L-shaped vertical slots of each of the door portions. Note FIG. 14B. In addition, the vertical strips may be placed in the front opening. It should be noted that the concealment afforded by the closure of the inverted L-shaped slots in combination with the vertical strips provides the necessary camouflage for hunting skittish deer. While hunting waterfowl or the like, both inverted L-shaped slots may be opened, as shown in FIG. 14A.

It should be noted that during any of the foregoing uses of the present invention, the window and door features provide various combinations to accommodate hunting different types of game with various weapons or engaging in other activities such as photography and observing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A folding hunters ground blind for providing comfort and concealment for extended periods of hunting, observing, ice fishing, or photographing wildlife comprising, in combination:

a folding frame portion including a top member, a bottom member, a front member, and a rear member, the top member having a generally rectangular shaped perimeter, a plurality of cross members extend between opposed long supports of the perimeter, the bottom member having a generally rectangular shaped perimeter including telescoping long and short supports, corners of the bottom member having upwardly extending receiving tubes disposed thereon, the front member having opposed upper members and lower members, the upper members telescopically coupled with the lower members, the lower members coupled with two of the upwardly extending receiving tubes of the bottom member, the upper members having a hinge member coupled to the top member, a U-shaped support extends between upper ends of the lower members of the front member, the rear member having opposed upper members and lower members, the upper members of the rear member telescopically coupled with the lower members of the rear member, the lower members of the rear member coupled with two of the upwardly extending receiving tubes of the bottom member, the upper members of the rear member having a hinge member coupled to the top member;

an adjustable arcuate support member secured to the cover system and extending adjacent the rear member of the folding frame portion;

a two-layer cover system dimensioned for extending over the folding frame portion and the arcuate support member to form an enclosure, the cover system including an interior layer fabricated of water-resistant camouflage material, the interior layer including a pair of door portions formed by inverted L-shaped openings, the vertical portions each having a bottom pile type fastener strip and a top zipper disposed thereon corresponding to a bottom pile type fastener strip and a top zipper on each one of the pair of door portions for closure thereof wherein the pile type fasteners allow for both covering and frame adjustments, the interior layer including side windows with a screen and adjustable front and rear windows each with a quietly removable screen that keeps out insects and a plurality of quietly removable vertical strips wherein all of the edges of the strips and the windows have leaf-shaped appendages protruding therefrom, the interior layer having adjustable tie down strips disposed on lower ends thereof and further a plurality of tie down loops centrally disposed thereon, the cover system, including an exterior layer comprised of three dimensional camouflage panels securable to the interior layer, the exterior layer including natural and artificial vegetation.

2. A hunters ground blind comprising:

a frame portion foldable in the form of a backpack; said frame portion includes a top member, a bottom member, a front member, and a rear member;

a cover system dimensioned to extend over the frame portion; said cover system is equipped with a pair of inverted L-shaped slots adapted to allow the selective opening thereover when hunting various game;

a front window situated on the cover system with a plurality of vertical strips removably coupled thereover; said front window further has a removable screen selectively situated thereover, whereby the screen is adapted to be penetrated by a weapon during use;

an adjustable support member is secured to the cover system adjacent a rear portion of the frame portion for providing more room within the blind for hunting;

said cover system further has a removable awning with a semicircular configuration situated above the front window for precluding light from entering the blind;

the top member having a generally rectangular shaped perimeter, a plurality of cross members extend between opposed long supports of the perimeter, the bottom member having a generally rectangular shaped perimeter including telescoping long and short supports, corners of the bottom member having upwardly extending receiving tubes disposed thereon, the front member having opposed first upper members and first lower members, said first upper members telescopically coupled with the first lower members, the first lower members coupled with two of the upwardly extending receiving tubes of the bottom member, the first upper members having a hinge member coupled to the top member, a U-shaped support extends between upper ends of the lower members of the front member, the rear member having opposed second upper members and second lower members, the second upper members telescopically coupled with the second lower members, the second lower members coupled with two of the upwardly extending receiving tubes of the bottom member, the second upper members having a hinge member coupled to the top member.

* * * * *